US009562409B2

(12) United States Patent
Xu

(10) Patent No.: US 9,562,409 B2
(45) Date of Patent: Feb. 7, 2017

(54) DOWNHOLE FRACTURE SYSTEM AND METHOD

(75) Inventor: Richard YingQing Xu, Tomball, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 1152 days.

(21) Appl. No.: 12/853,871

(22) Filed: Aug. 10, 2010

(65) Prior Publication Data

US 2012/0037373 A1 Feb. 16, 2012

(51) Int. Cl.

| | |
|---|---|
| ***E21B 43/26*** | (2006.01) |
| ***E21B 34/14*** | (2006.01) |
| ***E21B 21/10*** | (2006.01) |
| *E21B 34/00* | (2006.01) |

(52) U.S. Cl.

CPC ..... *E21B 21/103* (2013.01); *E21B 43/26* (2013.01); *E21B 2034/005* (2013.01)

(58) Field of Classification Search

CPC .... E21B 2034/005; E21B 34/10; E21B 34/14; E21B 43/26

USPC ..... 166/177.5, 373, 386, 320, 325, 271,166/334.4

See application file for complete search history.

(56) References Cited

U.S. PATENT DOCUMENTS

| | | | | |
|---|---|---|---|---|
| 3,602,311 | A | 8/1971 | Whitsitt | |
| 5,190,114 | A | 3/1993 | Walter | |
| 6,053,261 | A | 4/2000 | Walter | |
| 6,688,389 | B2 * | 2/2004 | Connell et al. | 166/255.1 |
| 6,732,803 | B2 * | 5/2004 | Garcia et al. | 166/373 |
| 6,877,558 | B2 * | 4/2005 | Connell et al. | 166/255.1 |
| 2002/0195248 | A1 | 12/2002 | Ingram et al. | |
| 2003/0075333 | A1 | 4/2003 | Vercaemer et al. | |
| 2004/0231849 | A1 | 11/2004 | Cooke | |
| 2006/0070740 | A1 | 4/2006 | Surjaatmadja et al. | |
| 2007/0272411 | A1 * | 11/2007 | Lopez De Cardenas et al. | 166/305.1 |
| 2008/0271923 | A1 | 11/2008 | Kusko et al. | |
| 2009/0065253 | A1 | 3/2009 | Suarez-Rivera et al. | |
| 2010/0294508 | A1 | 11/2010 | Xu et al. | |

OTHER PUBLICATIONS

International Search Report and Written Opinion; Date of Mailing Feb. 29, 2012, International Application No. PCT/US2011/047001; Korean Intellectual Property Office; International Search Report 5 pages; Written Opinion 3 pages.

Han et al. "Semi-Analytical Solutions for the Effect of Well Shut-Down on Rock Stability," Journal of Canadian Petroleum Technology, vol. 42, No. 12, Dec. 2003. [Abstract and Introduction Only].

Holzhausen et al. "Fracture closure pressures from free-oscillation measurements during stress testing in complex reservoirs," International Journal of Rock Mechanics and Mining Sciences & Geomechanics Abstracts, vol. 26, Issue 6, Dec. 1989, pp. 533-540. [Abstract Only].

* cited by examiner

*Primary Examiner* — Catherine Loikith

(74) *Attorney, Agent, or Firm* — Cantor Colburn, LLP

(57) ABSTRACT

A system for fracturing a subterranean formation includes a housing having one or more radially directed ports therein. A valve disposed within the housing proximate the one or more ports. A seat member interactive with the valve to rapidly prevent or substantially retard fluid flow therethrough. A method for initiating a fracture in a subterranean formation is included.

19 Claims, 3 Drawing Sheets

DOWNHOLE FRACTURE SYSTEM AND METHOD

BACKGROUND

In downhole industries, including hydrocarbon exploration and recovery, Carbon Dioxide Sequestration, etc., there is often an understanding that fracturing the earth formation in which a borehole is located will serve to enhance the operation being conducted.

In recent years many systems and apparatuses have been devised for fracturing the formation most of which utilize a pump at surface and any of a number of means to direct the pressure generated by the pump to the target area of interest.

While such methods are ubiquitously used they do require significant equipment resources especially with respect to pump horsepower to generate sufficient pressure to effect fracture. Alternative systems and methods of effecting fracturing will be welcomed by the art.

SUMMARY

A system for fracturing a subterranean formation including a housing having one or more radially directed ports therein; a valve disposed within the housing proximate the one or more ports; and a seat member interactive with the valve to rapidly prevent or substantially retard fluid flow therethrough.

A method for initiating a fracture in a subterranean formation including flowing a fluid at a given pressure through a system having a capability of rapidly and substantially retarding fluidic momentum in the fluid adjacent one or more radially oriented ports; rapidly and substantially retarding fluidic momentum in the flowing fluid; and initiating the fracture with a pressure spike resulting from the rapid and substantial retardation in fluidic momentum of the flowing fluid.

A system for fracturing a subterranean formation including a housing having one of more radially directed ports therein; and a configuration within the housing capable of rapidly and substantially retarding fluidic momentum of a fluid flowing therethrough resulting in a pressure spike sufficient to initiate fracture formation in a subterranean formation.

BRIEF DESCRIPTION OF THE DRAWINGS

Referring now to the drawings wherein like elements are numbered alike in the several Figures.

DETAILED DESCRIPTION

Figure 1:
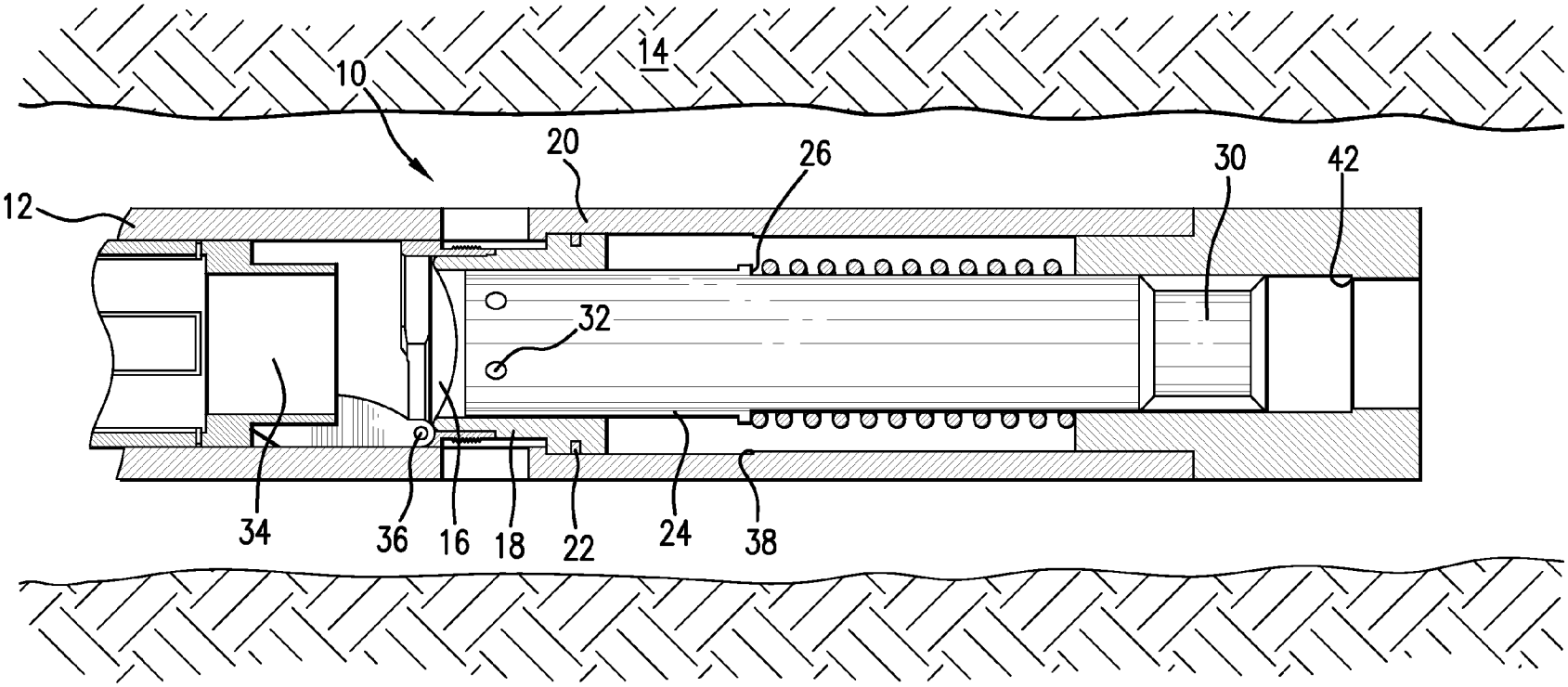
FIG. 1 is a cross sectional view of a portion of a system for fracturing a subterranean formation in a run-in position.

Referring to FIG. 1, a system 10 is illustrated that is configured to be a portion of a string 12 that can be run from a surface location into a borehole 14. The system 10 is capable of inducing a rapid pressure increase, commonly described as a "pressure spike", for the purpose of initiating fracture formation. The pressure spike is developed by and the system 10 is configured to effect a rapid retardation of fluidic momentum in a fluid flowing through the system 10. Flowing fluid in a conduit having a given pressure will experience a rapid increase in pressure at a location where that fluid is caused to suddenly decrease velocity or stop. The pressure spike generated by such phenomena is harnessed to initiate a fracture as described herein.

System 10, in one embodiment, includes a valve 16 that may be configured as a flapper valve. The valve 16 is intended to provide for the rapid retardation of fluidic momentum or stoppage of the fluid. In the illustrated embodiment the fluid will be stopped entirely as the flapper 16 will slam closed at a prescribed time and instantly stop fluid flow therethrough. The flapper in the illustrated embodiment is mounted to a flapper seat member 18 that is slidably disposed within an outer housing 20 of the system 10. A seal 22 is provided between the housing 20 and the member 18. At an interior of the member 18 is a flow tube 24 that defines a shoulder 26 for interaction with a spring 28 and fluid drag feature 30. The flow tube 24 is in one embodiment releasably affixed to the member 18 at release member 32. In one embodiment the release member 32 may be one or more shear members such as shear screws. A stop tube 34 is positioned in spaced relationship with the seat member 18 with a spacing dimension that allows the flapper 16 in the open position to be held open by the tube 34. A shoulder 38 is provided to limit downstream travel of the seat member 18 after the release member(s) 32 release.

Having introduced the operable components of the system it will be appreciated that in FIG. 1 the system is in a run-in position with the flapper 16 open and positioned radially outwardly of the stop tube 34 such that the flapper 16 cannot close. The flow tube 24 is affixed to the seat member 18 by release member(s) 32 and the spring 28 is in a relatively relaxed position. Upon application of fluid flow through the string 12, fluid moves through stop tube 34, past the open flapper 16, through seat member 18 and flow tube 24 into contact with the fluid drag feature 30. Because the fluid will not actually change in its own displacement, due to the action of the pump (not shown), the flow tube 24 will be urged in a downstream direction. Enough downstream movement of flow tube 24 is available if the flapper 16 can move far enough downstream to cease to be captured by the stop tube 34. Upon the flapper 16 escaping the capture position at stop tube 34, a torsion spring at 36 (common on flappers in downhole tools) will begin to close the flapper 16. Fluid momentum will help this action and the flapper 16 will rapidly close.

As the flapper 16 closes, a pressure spike is created that is related to a sudden retardation of fluidic momentum locally and the compressing force of the fluid column upstream that is still moving toward the source of fluid momentum retardation. In the illustrated case, this source is the closed flapper but it is to be understood that any fluid pathway closure, significant reduction in pathway dimensions or simply any other reason for flow to suddenly be significantly reduced will produce the pressure rise that is utilized in the invention. The ultimate pressure achieved by causing such a fluid retardation is several times (about three to about eight times) the initial pressure of the fluid.

Figure 2:
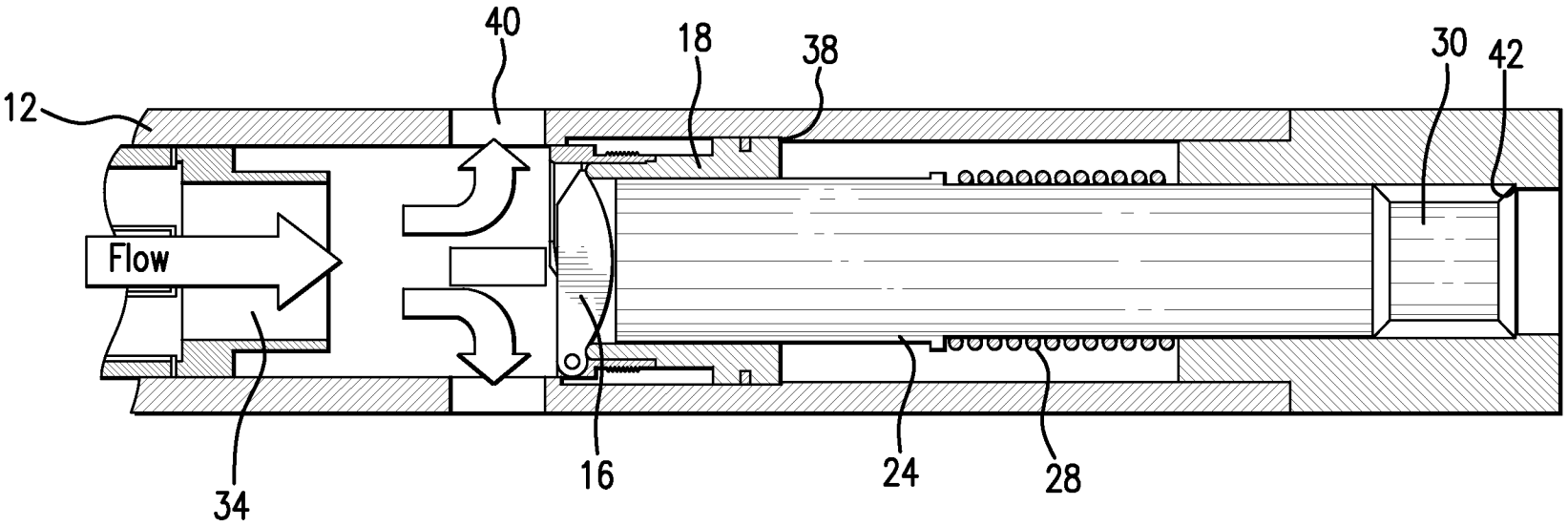
FIG. 2 is a cross sectional view of the system of FIG. 1 in a fracture position.

Referring to FIG. 2, the existence of ports 40 is more easily perceptible. This is because the seat member 18 has been moved in a downstream direction thereby uncovering the ports 40. Also to be noted is that the spring 28 is in a compressed condition in FIG. 2. This is due to the flapper 16 being closed and the fluid flow (longitudinal arrow) has continued to work on the closed flapper 16 seat member 18 and flow tube 24 through the intermediary of release member(s) 32. The hydraulic force on these components moves all of them downstream at once until the flow tube 24 lands on shoulder 42, at which point further downstream movement of the flow tube 24 is impossible. At this point in the process, the pressure spike is peaked and the pressure is directed through the ports 40 (one or more of them in various embodiments). The high pressure spike is directed to the formation 14 radially outwardly of the ports 40 and hence will cause a high degree of stress in that portion of the formation very quickly. This will optimally result in a fracture initiation in this location.

Fracture initiation requires the highest pressure of the entire fracturing operation as once fracture initiation has occurred; fracture propagation is maintainable at significantly lower pressures. Due to the pressure spike created by the concept disclosed herein, the pressure local to the system hereof is about three to about eight times the initial pressure of the flowing fluid. Beneficially, the horsepower required of a pump motor is much less than it has been previously as the only pressure required of the pump motor used in combination with the system and methods described herein is for fracture propagation. This represents a significant cost savings in equipment and operating expense.

DETAILED DESCRIPTION

Figure 3:
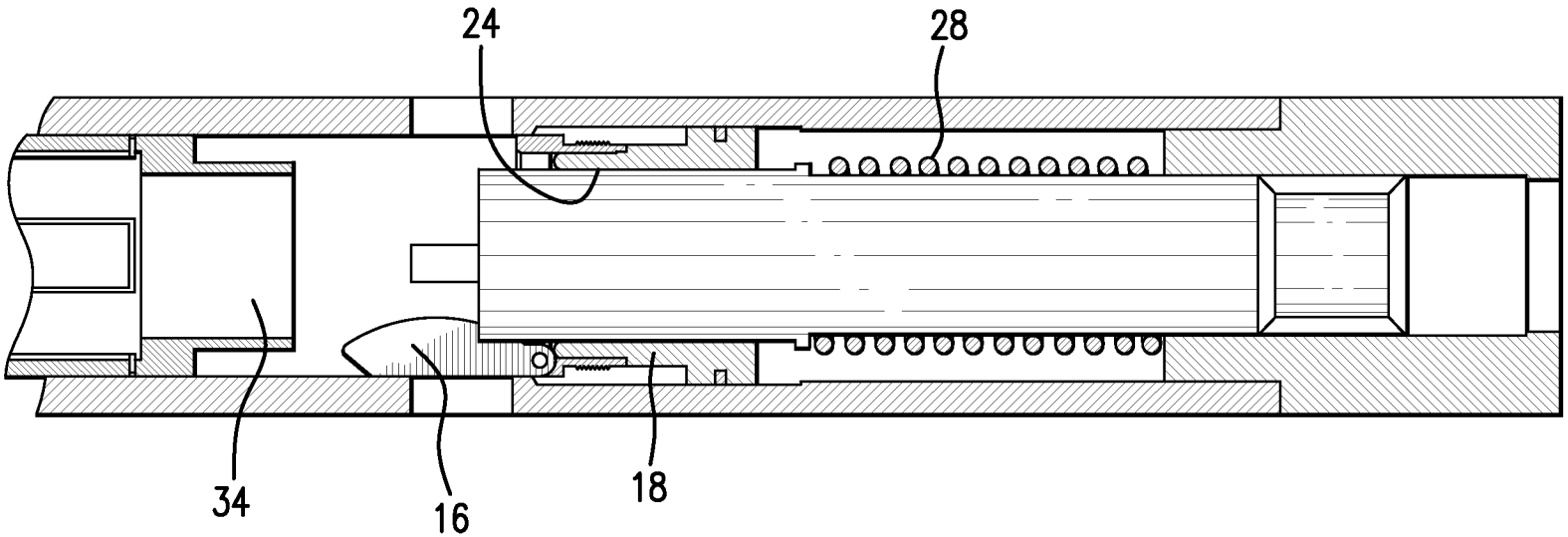
FIG. 3 is a cross sectional view of the system of FIG. 1 in a post fracture position.

At the same time that fracture initiation is occurring, the seat member 18 is being very heavily loaded against the flow tube 24 which cannot move farther downstream in view of the shoulder 42. At a point, which is set by the number of and resistance of the release member(s) 32, the release member (s) 32 will release and allow the seat member 18 to stroke downstream while the flow tube 24 remains stationary. The stroke of the seat member 18 is limited by the shoulder 38 to avoid unduly loading the pin (not separately numbered but within the torsion spring 36) in shear. The member 18 then is intended to land on the shoulder 38 only after the flow tube 24 lands on shoulder 42 and the release members 32 release. It is desirable to provide for stroke distance of the flow tube within the member 18 after the release members 32 release so that the flow tube 24 does not actually come into heavily loaded contact with the pressure closed flapper 16 but rather only more strongly contacts flapper 16 after pressure in the system is relieved and the spring 28 is the motive factor in control. Once the release members 32 are released the only thing resisting the spring 28 is the pressure from the fluid column. Upon relief of the pressure the flow tube 24 will move again to open flapper 16 under the influence of the spring 28, which as can be seen in FIG. 2 is compressed at this point in the process. This condition of the system 10 can be seen in FIG. 3. The flow pathway through the system is hence once again open and another operation such as production, for example, can begin.

In view of the foregoing one of ordinary skill in the art will understand that the method for initiating a fracture in a subterranean formation includes operating a system capable of creating a pressure spike due to a rapid and substantial retardation of fluidic momentum in a fluid flowing through the system, the pressure spike occurring proximate one or more ports in a housing that is a part of the system. The method includes causing fracture initiation with the pressure spike. The method further includes one or more of the steps inherent in using the system components discussed above.

There are many factors that can affect the magnitude of the pressure spike including flow rate, fluid density, tubing string stiffness, etc. Each of these can be manipulated to fit a particular application. The greatest factor on the magnitude of the pressure spike is however the speed at which the flow can be stopped since the more gradual the stoppage of fluid flow, the less ultimate compression of the local fluid is achieved.

While one or more embodiments have been shown and described, modifications and substitutions may be made thereto without departing from the spirit and scope of the invention. Accordingly, it is to be understood that the present invention has been described by way of illustrations and not limitation.

The invention claimed is:

1. A system for fracturing a subterranean formation comprising:

a housing having one or more radially directed ports therein;

a valve disposed within the housing proximate the one or more ports; and a seat member interactive with the valve to rapidly prevent or substantially retard a fluid flow therethrough, resulting in a local pressure spike in the fluid created solely by retardation of fluidic momentum when the system is in use, the pressure spike initiating fracture formation without pressuring up from surface.

2. A system as claimed in claim 1 wherein the valve is a flapper.

3. A system as claimed in claim 1 wherein the seat member is slidably disposed within the housing.

4. A system as claimed in claim 1 further comprising a flow tube disposed within the seat member.

5. A system as claimed in claim 4 wherein the flow tube is releasably affixed to the seat member by one or more release members.

6. A system as claimed in claim 5 wherein the one or more release members are one or more shear members.

7. A system as claimed in claim 4 wherein the flow tube includes a fluid drag inducing feature.

8. A system as claimed in claim 4 wherein the flow tube is interactive with a spring, the spring compressing during initial operation of the system and urging the flow tube to a final position after one or more release members disposed at the flow tube release.

9. A method for initiating a fracture in a subterranean formation comprising:

flowing a fluid at a given pressure through a system having a capability of rapidly and substantially retarding fluidic momentum in the fluid adjacent one or more radially oriented ports;

rapidly and substantially retarding fluidic momentum in the flowing fluid; and initiating the fracture with a pressure spike resulting solely from the rapid and substantial retardation in fluidic momentum of the flowing fluid.

10. A method as claimed in claim 9 wherein the retarding includes closing a valve.

11. A method as claimed in claim 10 wherein the closing is complete.

12. A method as claimed in claim 10 wherein the valve is a flapper.

13. A method as claimed in claim 9 wherein the method further comprises urging a flow tube of the system in a direction downstream of the flowing fluid.

14. A method as claimed in claim 13 wherein the method further comprises compressing a spring with the flow tube.

15. A method as claimed in claim 14 wherein the method further comprises freeing a release member of the flow tube and urging the flow tube through a valve of the system thereby opening the valve to fluid flow.

16. A method as claimed in claim 9 wherein the method further comprises causing a pressure spike in the flowing fluid locally to the system.

17. A method as claimed in claim 16 wherein the pressure spike is on the order of about three to about eight times an initial flowing fluid pressure.

18. A method as claimed in claim 9 wherein the retarding is by urging a flow tube and attached valve and seat member downstream to release the valve thereby enabling closure of the valve.

19. A system for fracturing a subterranean formation comprising:

a housing having one or more radially directed ports therein; and a configuration within the housing capable of rapidly and substantially retarding fluidic momentum of a fluid flowing therethrough resulting in a pressure spike created solely by the retardation of fluidic momentum sufficient to initiate fracture formation in a subterranean formation.

* * * * *